United States Patent [19]

Haga

[11] 4,422,465

[45] Dec. 27, 1983

[54] NAIL FILE AND METHOD FOR PRODUCING THE SAME

[75] Inventor: Tomoyuki Haga, Tokyo, Japan

[73] Assignee: Shiseido Company, Ltd., Tokyo, Japan

[21] Appl. No.: 198,230

[22] Filed: Oct. 17, 1980

[51] Int. Cl.[3] ..... A45D 29/04

[52] U.S. Cl. ..... 132/76.4; 76/24 C

[58] Field of Search ..... 132/76.4, 75.6; 76/24 R, 24 C; 29/78–79

[56] References Cited

U.S. PATENT DOCUMENTS

| | | | |
|---|---|---|---|
| 852,873 | 5/1907 | Davidson | 76/24 C |
| 1,418,974 | 6/1922 | Rodow | 29/78 |
| 2,087,484 | 7/1937 | Seedlock | 29/78 |
| 3,543,362 | 3/1967 | Steding | 76/24 C X |
| 4,091,516 | 5/1978 | Jensen | 29/78 |
| 4,240,806 | 12/1980 | Frantzen | 29/78 |

*Primary Examiner*—Gregory E. McNeill
*Attorney, Agent, or Firm*—Austin R. Miller

[57] ABSTRACT

A nail file having an excellent and uniform filing property and a method for greatly facilitating the manufacture of same are provided. This nail file has a number of file blade formed by a number of edge lines of concave portions randomly or irregularly etched in the surface of a flat metal plate. These concave portions have a diameter of 100 through 300 microns, a depth of 10 through 80 microns and a distance between the adjacent edge lines of 10 through 100 microns. The concave portions are photographically etched in the surface of a flat metal plate by using a photosensitive resin.

2 Claims, 9 Drawing Figures

NAIL FILE AND METHOD FOR PRODUCING THE SAME

The present invention relates to a nail file and a method for producing the same.

Typical nail files heretofore known in the art are:

A. Nickel plated files containing alumina powder therein;

B. Nickel electroformed files;

C. Files obtained by dressing iron plates with a diamond cutter or a cemented carbide cutter; and D. Files obtained by bonding abrasive materials onto paper and plate materials with adhesives.

The above-mentioned nickel plated files A are produced by first mixing alumina ($Al_2O_3$) powder with a nickel plating solution under agitation to uniformly distribute the alumina powder in the nickel plating solution and, then, forming a nickel plating layer with the resultant nickel plating solution, whereby the alumina powder is contained in the nickel plating layer. The alumina powder particles exposed on the surface of the nickel plating layer serve as teeth of the file. However, in these nail files A, since the stabilization of the production process is difficult and also since the arrangement of the exposed alumina particles on the nickel plating layer varies widely in each production the filing property of the nail files thus produced is not uniform and varies widely from product the product.

The nickel electroformed files B are produced, according to a conventional thick film plating method wherein a prototype having a desired pattern of a nail file is placed in an anode side and forming a thick plating layer on the prototype in a nickel plating solution. The produced file pattern is then removed from the prototype. However, there are defects in these nickel electroformed files B that the productivity is low due to the fact that a long plating time is needed and that the filing property of the nail files thus produced is not of good quality due to the fact that the formation of sharp teeth is difficult because the files B are removed from the prototype.

The files C produced by the dressing of iron plates can be easily and simply produced. However, the formation of fine file teeth is difficult and the filing property is not good due to the presence of a directional property in the file teeth. The paper files D are not practical for the reason that the durability thereof is remarkably poor.

As mentioned above, the conventional nail files have the disadvantages in that the filing property is poor, the filing property is not uniform and varies widely from product to product and the productivity is low.

Accordingly, an object of the present invention is to obviate the above-mentioned disadvantages of the conventional nail files and to provide a new nail file having an excellent, uniform and constant filing property and a good durability.

Another object of the present invention is to provide a method for producing the above-mentioned new nail file at a high productivity.

Other objects and advantages of the present invention will be apparent from the following description.

In accordance with the present invention, there is provided a nail file having a number of file blades formed by a number of edge lines of concave portions, which are etched in the surface of a flat metal plate, the arrangement of said concave portions being random or irregular the diameter of said concave portions being within the range of 100 to 300 microns, the depth of said concave portions being within the range of 10 to 80 microns and the distance between the adjacent edge lines of said concave portions being within the range of 10 to 100 microns.

In accordance with the present invention, there is also provided a method for producing a nail file comprising the steps of:

(1) applying a layer of a photosensitive resin on the surface of a flat metal plate;

(2) photographically printing desired patterns of file teeth followed by developing the printed photosensitive resin layer, whereby the photoresist patterns corresponding to the desired file tooth patterns are formed on the flat metal plate; and (3) etching the resultant flat metal plate, whereby the file teeth are formed by a number of edge lines of concave portions randomly or irregularly etched in the surface of the flat metal plate, the diameters of said concave portions being within the range of 100 to 300 microns, the distance between the adjacent edge lines of the concave portions being within the range of 10 to 100 microns and the depth of the concave portions being within the range of 10 to 80 microns.

The present invention will be better understood from the description set forth below with reference to the accompanying drawings in which.

Figure 1:
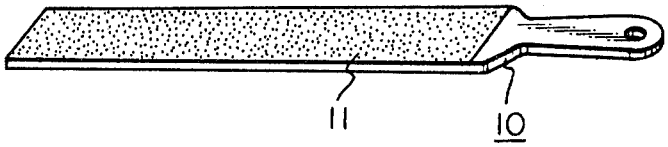
FIG. 1 is a schematic perspective view illustrating one embodiment of the present nail file.
Figure 2:
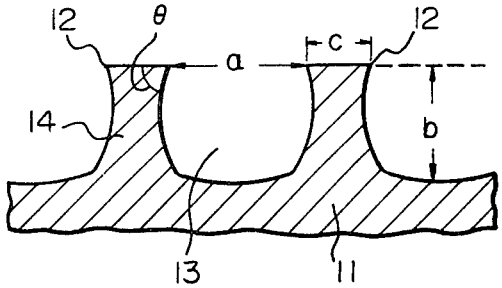
FIG. 2 is an enlarge schematic partial sectional partial sectional view illustrating one embodiment of the present nail file.

Referring to FIGS. 1 and 2, a nail file 10 of the present invention have file teeth 11 on at least one surface of flat metal plate, as shown in FIG. 2, a number of file blades are formed by a number of edge lines 12 of the concave portions 13 in the file teeth 11. As set forth above, the diameter a of the concave portions 13 (i.e. the blade distance) should be within the range of 100 to 300 microns, preferably 100 to 150 microns, the depth b of the concave portions 13 (i.e. the blade height) should be within the range of 10 to 80 microns, preferably 50 to 60 microns, and the distance between the adjacent edge lines 12 (i.e. the head diameter) should be within the range of 10 to 100 microns, preferably 40 to 60 microns.

The angle $\theta$ of the blades should be less than 90°, preferably approximately 70°.

In the case where the diameter a is larger than 300 microns, a nail filing cannot be smoothly effected due to the fact that nails, when filed, lodge in the concave portions 13. Contrary to this, in the case where the diameter is smaller than 100 microns, a desired nail filing cannot also be effected due to the fact that nails to be filed extend over two or more heads 14 (i.e. the portions which lay between the adjacent edge lines).

Generally speaking, the amount of the nail filings increases as the depth b of the concave portions 13 increases. However, in the case where the depth b of the concave portions is more than 80 microns, the filing becomes difficult due to the increase in the filing resistance. Contrary to this, in the case where the depth b of the concave portions is less than 10 microns, the amount of nail filings is remarkably decreased. Thus, the depth b of the concave portions, i.e. the height of the blades, should be 10 through 80 microns.

Furthermore, the distance c between the adjacent edge lines 12 of the concave portions, i.e. the diameter of heads 14, should be within the range of 10 to 100 microns. In the case where the distance c is more than 100 microns the filing property decreases due to the fact that nails are liable to slip on the surface of the heads 14. On the other hand, in the case where the distance c is less than 10 microns, effective blades cannot be formed since no substantial distance c is present between the adjacent edge lines of the concave portions 13.

The angle $\theta$ of the blades should be less than 90°. In the case where the angle $\theta$ is 90° or more, nails cannot be smoothly filed due to the increase in the filing resistance.

In addition to the above-mentioned requirements the concave portions 13 should be randomly or irregularly arranged in the surface of a metal plate. As will be explained hereinbelow, a typical example of enlarged original patterns A of the concave portion of the present nail file is illustratively shown in FIG. 3. The shape of each pattern A can be any shape including a circular form, an ellipsoid form, a polygonal form and the like, so long as the patterns are randomly arranged. The original patterns A randomly arranged in a suitable medium such as a photographic film are photographically printed on the surface of a metal plate, as illustrated in FIG. 4, in the reduced form. The patterns B in FIG. 4 are reduced to a scale of one-sixty fourth of the patterns A in FIG. 3. However, it should be noted that this reduction scale can be suitably determined so that the above-mentioned requirements concerning the dimensions a, b and c are satisfied.

Figure 5:
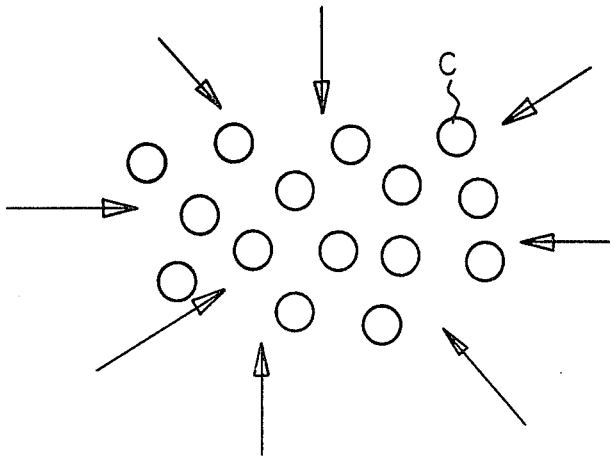
FIG. 5 is a schematic front view illustrating one example of a pattern of file teeth which are randomly or irregularly arranged.
Figure 6:
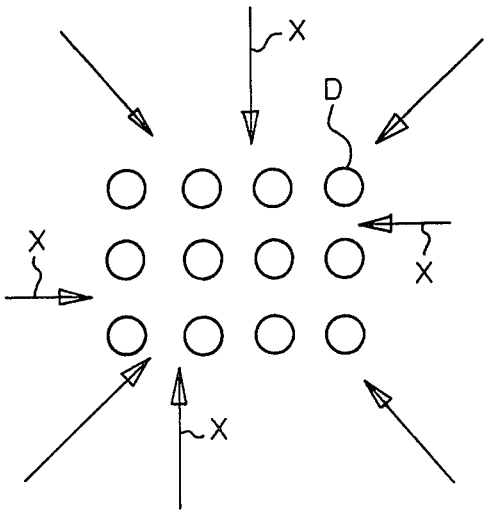
FIG. 6 is a schematic front view illustrating one example of a pattern of file teeth which are regularly arranged.

Since the file teeth (i.e. the concave portions) of the present nail file are randomly arranged, there is no directional property in filing nails. As a result, nails can be effectively filed with the present nail file regardless of their operational directions. For instance, in the case where patterns C are randomly arranged in a nail file as illustrated in FIG. 5, nails can be filed in any directions represented by the arrow. Contary to this, in the case where patterns D are regularly arranged in a nail file as illustrated in FIG. 6, it is clear that nails cannot be effectively filed when the nail file is operated in the directions represented by the arrow X.

In addition, since the surface of the present nail file is flat, there is not fear that nails are injured by careless operations. The present nail file can also be suitable for use in cutting or grinding of calluses or hardened skin of, for example, elbows, knees and heels.

Figure 9:
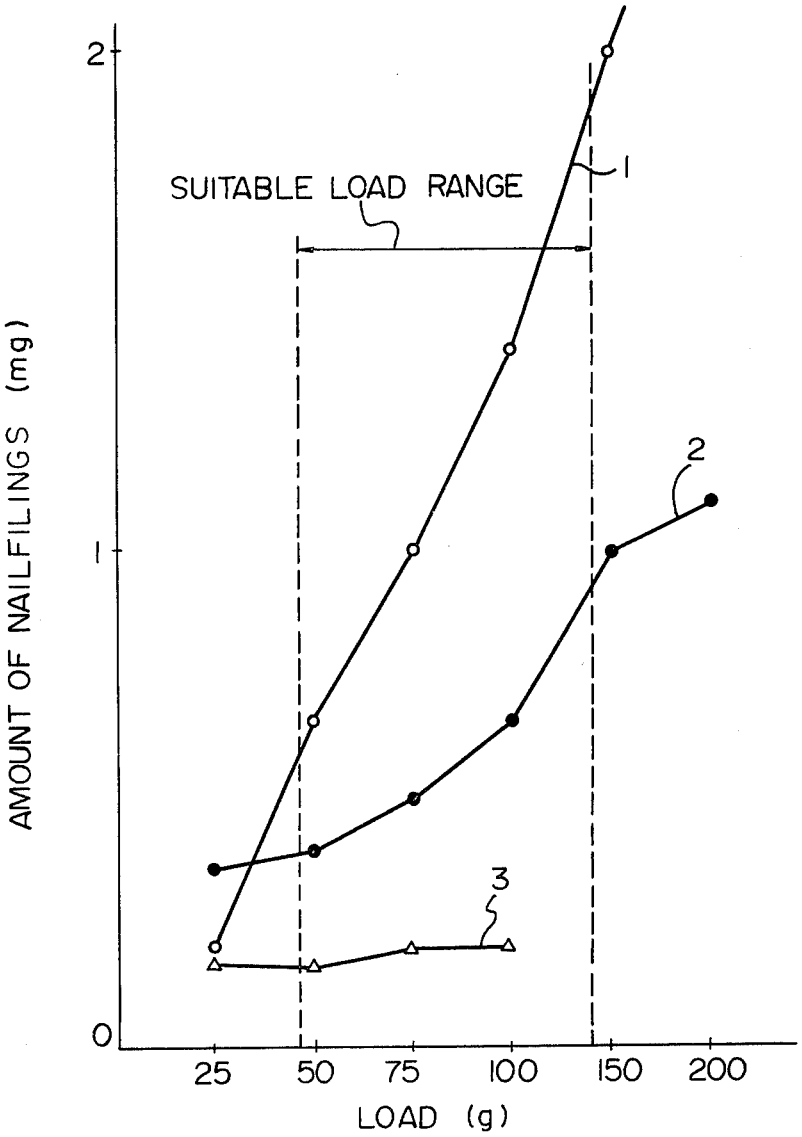
FIG. 9 is a graph showing the correlations between loads and amounts of nail filings with respect to three samples.

Since the present nail file has the above-mentioned structure, an excellent filing property can be obtained. For instance, as illustrated in FIG. 9, the amount of nail filings of the present nail file (i.e. curve 1 of FIG. 9) is remarkably higher than those of a conventional alumina powder-containing nickel plated nail file (i.e. curve 2 of FIG. 9) and a conventional nickel electroformed files (i.e. curve 3 of FIG. 9) within a suitable load range of nail filing, which is generally about 40 through 130 g. Especially, the amount of nail filings obtained by using the present nail file remarkably increases with the increase in the load applied to the nail file. The amount of nail filings of the present nail file is higher, it is about double that of a conventional alumina powder-containing nickel plated nail file at a load of 130 g and the amount of nail filing of the present nail file is higher, by about ten times, than that of conventional nickel electroformed files.

Figure 7:
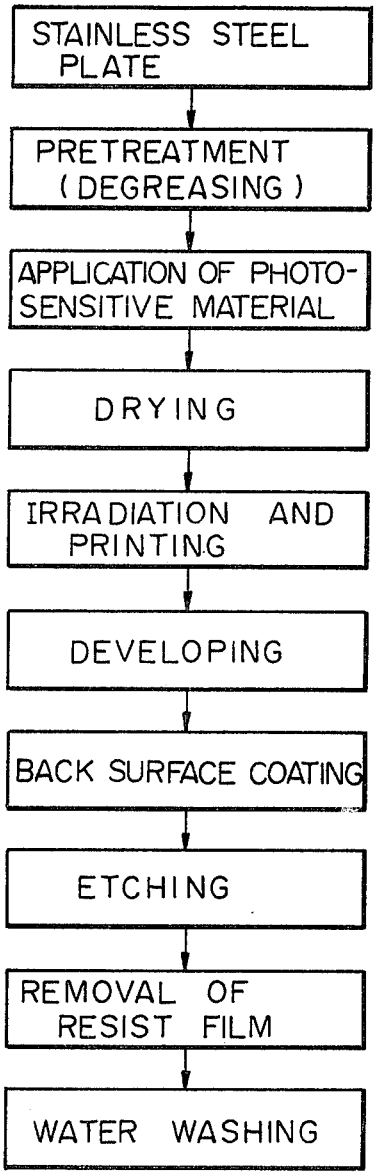
FIG. 7 is a drawing illustrating the production steps of the present nail file.
Figure 8:
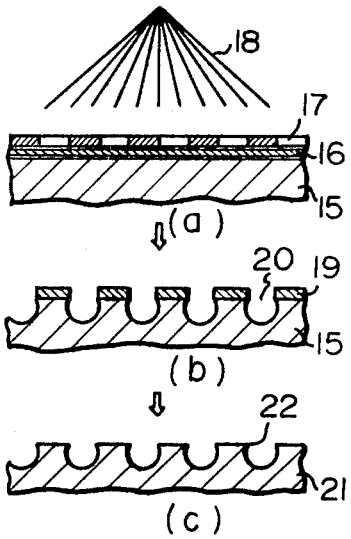
FIG. 8 is a schematic sectional view illustrating (*a*) the irradiation, (*b*) the etching and (*c*) the resist film removal steps of the production of the present nail file.

Referring to FIGS. 7 and 8, one example of the production method of the present nail file will now be explained.

A metal plate 15 such as a stainless steel plate is first preferably subjected to a pretreatment including degreasing and, then, any conventional photosensitive resin layer 16 is coated on the surface of the metal plate 15 and dried. On the other hand, an original negative film 17 having the negative image of desired patterns of file teeth is prepared. The photosensitive resin layer 16 on the metal plate 15 is imagewise irradiated through the original negative film 17 by a suitable light 18, as shown in FIG. 8(*a*). Thus, the desired patterns are printed in the photosensitive resin layer 16.

The latent image of the desired patterns is developed in a conventional manner, and, then, the back surface of the metal plate 15 is coated with a resin coating composition. The metal plate 15 having the resultant photoresist film layer 19 is etched so that the etched depth of the concave portions 20 become 10 to 80 microns. This photo-etching technique is well-known in the art, as a photomechanical process, but any conventional photo-etching technique can be used in the present invention. For instance, an aqueous ferric chloride solution containing a small amount of a mineral acid (e.g. hydrochloride acid) can be advantageously used, as an etching solution, in the case of a stainless steel plate. The etching time can be appropriately determined depending on the type of the metal plate, the kind of an etching solution and the like. Generally speaking, the flat metal plate 15 having the resist film layer 19 is etched for about one minute through several minutes so as to form the concave portions 20 having a depth of 10 through 80 microns. Thus, the etched metal plate 15 having the resist film layer 19 is formed, as shown in FIG. 8(*b*). After etching, the resist film layer 19 is removed by brushing or by using an appropriate solvent and the resultant metal plate 21 having the desired file teeth 22 on the surface thereof, as illustrated in FIG. 8(*c*), is obtained. This metal plate 21 is washed with water and dried. The metal plate 21 thus obtained can be cut into nail files each having an appropriate size.

According to the present invention, since the nail files are produced by using a photo-etching technique, the mass-production of the nail files can be readily carried out, compared with the production methods of conventional nail fies. Thus, according to the present invention, the manufacture productivity of nail files is remarkably increased and the production cost thereof can be decreased. In addition, according to the present invention, the file teeth can be stably formed in the surface of the nail file. In the manufacture of nail files, a flat metal plate such as a copper plate, a nickel plate, an aluminum plate, an iron plate and the like which are used in the production of conventional nail files, can also be used in the present invention. However, there are problems namely that copper, iron and aluminum are liable to rust and corrode, and that nickel irritates human skin and is expensive. Contrary to this, since a photo-etching technique is used in the present invention, a flat stainless steel plate can be easily used as the metal plate of the nail file. Furthermore, since stainless steel has excellent corrosion resistance and hardness, as compared with the above-mentioned conventional metal plates, and since stainless steel is cheaper than aluminum and nickel, stainless steel is the most preferable material to use as a flat metal plate, in the present invention.

The present invention will be further illustrated by the following example. However, it should be understood that the following example is given merely to explain and not to limit the present invention and numerous changes may be made without departing from the basic idea and the scope of the present invention as will be claimed below.

EXAMPLE

Figure 3:
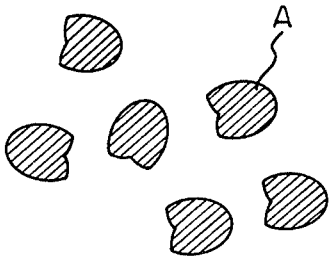
FIG. 3 is a schematic front view illustrating one embodiment of the original patterns, before reduction, of the file teeth of the present nail file.
Figure 4:
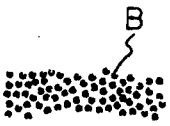
FIG. 4 is a schematic front view illustrating one embodiment of the file teeth of the present nail file the reduction of which from the patterns shown in FIG. 3 is one-sixty fourth.

The random patterns as illustrated in FIG. 3 were used as an original prototype and a negative film having the random patterns was photographically prepared. This negative film was then reduced to a scale of one-sixty fourth. Twelve reduced negative films were combined to obtain one negative film having negative images of the desired random patterns.

On a flat 18Cr-8Ni stainless steel plate, which was previously degreased and washed, a photosensitive polyvinyl alcohol solution having the following composition was coated.

Polyvinyl alcohol (polymerization degree=500, partially saponified): 80 g
Ammonium bichromate: 17 g
Water: 1000 ml The coated stainless steel plate was dried at a room temperature.

The above-prepared negative film was laid over the coated stainless steel plate and the photosensitive polyvinyl alcohol layer was irradiated or exposed through the negative film for about 40 secs. The exposed layer was developed with a developing agent. Thus, no exposed portions were dissolved and removed from the surface of the stainless steel plate, and the exposed portions remained. Thus, photoresist film was formed on the surface of the stainless steel plate.

After the back surface of the stainless steel plate was coated with a low-molecular weight acrylic resin coating composition, the resultant stainless steel plate was etched by using an aqueous ferric chloride solution (to which a small amount of hydrochloric acid was added) at a solution temperature of 40° C. for 2 minutes and 20 seconds, whereby no exposed portions were etched. The depth of the etched portions was approximately 50 microns. After etching, the photoresist film was removed by buffing and, then, the resultant stainless steel plate having etched concave portions thereon was washed with water. The flat stainless steel plate thus obtained was cut into portions of an appropriate size to obtain the desired nail files. The above-mentioned production steps are shown in FIG. 7.

The nail files thus produced had concave portions randomly arranged in the surface thereof, a diameter of the concave portions of about 200 microns, the depth of the concave portions was about 50 microns and the distance between the adjacent edge lines of the concave portions was about 40 microns. The filing property of the nail files were excellent as shown in curve 1 of FIG. 9, as compared with conventional nail files (i.e. curves 2 and 3 of FIG. 9).

I claim:

1. A nail file having a number of file blades formed by a number of edge lines or concave portions, which are etched in the surface of flat metal plate, the arrangement of said concave portions being random or irregular, the diameter a of said concave portions being within the range of 100 to 300 microns, the depth b of said concave portions being within the range of 10 to 60 microns, the distance c between the adjacent edge lines of said concave portions being within the range of 10 to 60 microns and the angle $\theta$ of the blades being less than 90°.

2. A nail file as claimed in claim 1, wherein said flat metal plate is a flat stainless steel.

* * * * *